United States Patent [19]

Niitti

[11] 4,329,767

[45] May 18, 1982

[54] METHOD FOR CONTINUAL REPLACEMENT OF THE RUBBER LINING IN A ROTATING MILL

[75] Inventor: Timo U. Niitti, Espoo, Finland

[73] Assignee: Outokumpu Oy, Outokumpu, Finland

[21] Appl. No.: 128,393

[22] Filed: Mar. 10, 1980

[30] Foreign Application Priority Data

Mar. 14, 1979 [FI] Finland ..... 790864

[51] Int. Cl.[3] ..... B22D 19/10; B02C 17/14

[52] U.S. Cl. ..... 29/402.08; 241/182; 241/DIG. 30; 29/402.11

[58] Field of Search ..... 29/402.09, 402.18, 155 R, 29/155 C, 402.08, 402.11, 402.12, 402.14, 183; 241/DIG. 30, 182, 102

[56] References Cited

U.S. PATENT DOCUMENTS

| | | | |
|---|---|---|---|
| 3,378,209 | 4/1968 | Crocheron | 241/182 X |
| 3,804,346 | 4/1974 | Norman | 241/182 |
| 3,883,080 | 5/1975 | Andersson | 241/182 |
| 3,934,828 | 1/1976 | Persson | 241/182 |

*Primary Examiner*—Francis S. Husar
*Assistant Examiner*—V. K. Rising
*Attorney, Agent, or Firm*—Brooks, Haidt, Haffner & Delahunty

[57] ABSTRACT

A method is described for sequential replacement of the lining in a rotating mill according to wear of the lining. Generally, such a lining consists of adjacent zones parallel to the rotational axis of the mill, the height of these zones varying periodically in the peripheral direction of the mill. According to the invention rubber beams of equal width are used, and for the replacement operation completely fresh beams of only one height are employed, this height representing the highest one of only a few preselected categories of beams. Upon removal of worn beams, these are reassorted according to the selected categories and those beams worn-out and unfit for even the lowest category are discarded. Thus, the reassorted beams not rejected can be reused properly positioned so as to maintain a suitable variation of the beam height in the peripheral direction of the mill, and only one height of fresh beams need to be held in stock. When replacing, the particular beam category may be retained at a certain beam position, or completely fresh beams may be inserted at positions of beams completely discarded, whereby the desired variation of beam height in the peripheral direction is obtained by suitable replacement or rearrangement of the remaining beams.

9 Claims, 6 Drawing Figures

METHOD FOR CONTINUAL REPLACEMENT OF THE RUBBER LINING IN A ROTATING MILL

BACKGROUND OF THE INVENTION

1. Field of the Invention

The present invention relates to a method for continual replacement of the lining in a rotating mill as the lining wears, in which case, in the initial situation, the lining consists of adjacent zones parallel to the rotational axis of the mill, the height of the zones varying in the peripheral direction of the mill.

2. Description of the Prior Art

Known rubber linings usually comprise low, wide beams alternating with higher, narrow beams. As generally known, the high discard precentage currently constitutes the greatest disadvantage of the rubber linings currently used. Nowadays, the rubber lining must be replaced when still about 40% of the weight of the lining remains. Owing to the high price of this material, this is a considerable economic loss, for the use found for the worn-out beams is secondary at its best.

SUMMARY OF THE INVENTION

The present invention provides a method for the sequential replacement of the rubber lining of a rotating mill, and of the character described above, this method comprising using rubber beams of equal width and completely new beams of only one height, removing, as the lining wears, the worn-out beams sequentially, assorting the removed beams into a few categories according to their height, the categories having been suitably selected on the basis of the lining profile, discarding removed beams unfit for even the most worn-out group, and replacing the removed beams with beams of appropriate category so as to maintain a suitable variation of beam height in the peripheral direction of the mill, thereby using, according to need completely new and replaced, reassorted beams, respectively.

Thus, one object of the present invention is to provide a method for replacing the lining, this method making it possible to reduce substantially the discard percentage, as compared with previous methods. The invention is based on the use of adjacent beams of equal width, a use which is known as such in metal beam linings. According to the ivention, the rubber beams of equal width are assorted into a few suitable categories according to their height, i.e. their degree of wear, and worn beams are always reassorted until they are unusable, in which case completely new beams of only one size are required.

The advantages of the method according to the invention include, in addition to the reduced discard percentage:

- easy adaptation to old metal-lined mills, since new perforations are usually not necessary
- the small number of attachment bolts and respectively the small number of perforations in the mantle
- the reduced number of types of lining parts (no separate raised beams and mantle plates)
- the simple structure of the lining beam results in simple molds and an inexpensive manufacturing method (nozzle compression), whereby the mold and labor costs are reduced from their present level after replacement, the lining is definitely uneven, in which case the material to be ground partly adheres to the depressions in the lining and thereby protects the thinnest parts of the lining from wear. The unevenness also prevents the pieces being ground from sliding along the lining, and thereby reduces wear
- the distance of the co-called raised beams from each other can easily be changed since their positions are not determined by the perforation in the mantle. Thus, finding an optimum profile in each case is easy as regards both the grinding capacity and wear
- The complete symmetry and interchangeability of the beams make it possible to turn them if uneven wear appears, for example in the immediate vicinity of the furnace. Thereby even wear and a low reject percentage are achieved.

Depending on the number of different categories that it is convenient to use and on the extent to which the profile of the lining must be maintained or is desirable to maintain, the reject percentage can be reduced by the method according to the invention to about 10–15%, which makes rubber lining highly competitive.

DESCRIPTION OF THE PREFERRED EMBODIMENTS

Figure 1:
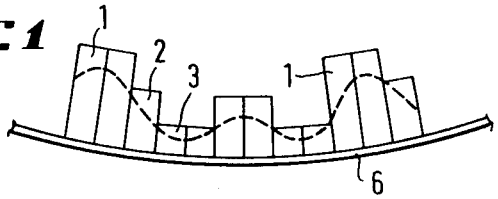
FIGS. 1–4 show the various stages of replacement of the lining

FIG. 1 depicts a section of the wall of a cylindrical mill, which has been lined with rubber beams 1, 2 and 3 extending in a direction parallel to the axis of the mill, the beams being of equal width and of three different heights. The beams have been placed systematically next to each other so as to achieve the desired height profile in which the heights alternate sequentially.

Figure 2:
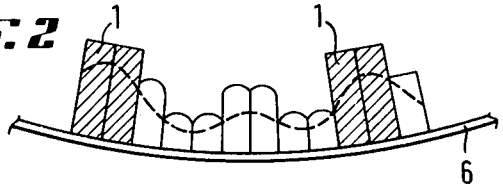

When the rubber beams have worn from the initial state shown in FIG. 1 in the manner indicated by the dotted line in FIG. 1, the first stage of replacement is carried out. This is indicated in FIG. 2, where the replaced beams 1 are indicated by slanted ruling. In FIG. 2, also, the next stage of wear is indicated by a dotted line.

Figure 3:
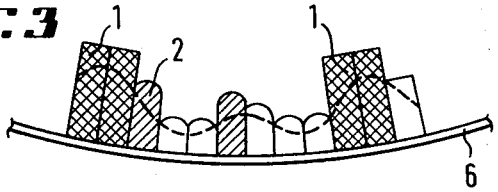

FIG. 3 depicts the next replacement stage and in it the once replaced beams 2 are indicated with slanted ruling and the twice replaced beams 1 with cross hatching.

Figure 4:
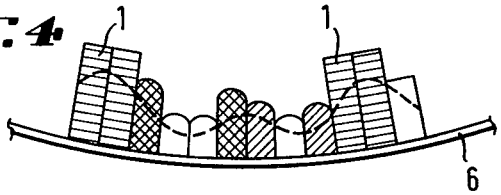

FIG. 4 shows with generally horizontal ruling the beams replaced three times, with cross hatching the twice replaced beams and with slanted ruling the once replaced ones. In FIGS. 3 and 4, as in FIGS. 1 and 2, the lowered profile caused by wear is indicated by a dotted line.

The idea of the invention lies in that the removed beams are reassorted, and only those beams which are unfit for even the most worn category, i.e. the lowest category, are rejected. But the replaced beams are reused either immediately in connection with the same replacement or at a later replacement stage. In this way, new beams of only one size are required, and they thus belong in category 1.

On the basis of the above, it should be evident that FIG. 1 is only schematic. In practice, only beams 1 in it are angular, the other beams are approximately of the height depicted but already rounded by wear.

In the example case, the time of each replacement is determined by the need to replace the highest beams 1.

It is evident, however, that the replacement can also take place on the basis of some other criterion which is considered appropriate.

In the example case, a beam classified in a certain category is always installed in one and the same place. In this way, the profile of the lining remains unchanged. However, it is also possible to vary the profile in connection with the replacement, for example so that a completely new beam belonging to category 1 is substituted for a completely rejected beam, in which case it is possible that the beams in between need to be replaced less often than otherwise. In this case it is, of course, a prerequisite that the replacement ystem in question continues to maintain an appropriate lining profile.

It should be pointed out that the profiles of the worn beams depicted in FIGS. 2–4 do not fully correspond to the cross section according to the wear curve of the previous figure, but the figures are schematic and depict only the idea of the invention. In the example case, the sequence comprises nine beams, and for the beam extreme to the right in the figures, no replacement is depicted.

Figure 5:
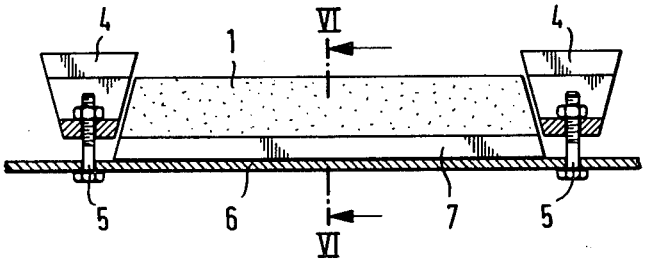
FIG. 5 is a schematic representation of the attachment of a rubber beam as seen from the side.

FIG. 5 illustrates one way of attaching the rubber beam, the method being substantially known per se in connection with metal beams. The ends of the beam 1 are beveled so that the beam is longest at its base. The attaching members are attaching strips 4, which extend in the peripheral direction of the mill and have a cross section which converges downwards. The strips 4 are attached to the mantle 6 of the mill by means of bolts 5. The strips 4 can be metal or, alternatively, rubber as the beams. This attachment method, together with the uniform width of the beams, allows arbitrary variation of the order of the beams and thereby of the lining profile.

Figure 6:
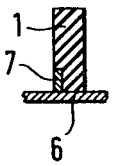
FIG. 6 depicts the cross section of a rubber beam.

FIG. 6 depicts schematically a cross section of the beam. The beam is rubber, except that its base has a flat metal bar 7 reinforcing the entire length of the beam. The reinforcement can, of course, also be some other suitable stiffener.

What is claimed is:

1. A method of continually replacing the rubber lining of a rotating mill as the lining wears, such lining consisting in its initial state of adjacent zones parallel to the rotational axis of the mill and the height of the zones varying in the peripheral direction of the mill, the method comprising using rubber beams of equal width and new beams of only one height, which is greater than the height of any other beams in the lining, said other beams being worn in varying degrees removing, as the lining wears, the worn beams, sorting the removed beams into a few categories according to their height, the categories having been selected on the basis of the lining profile, discarding removed beams unfit for even the lowest height group, and replacing the removed beams with beams of selected category so as to maintain a suitable variation of beam height in the peripheral direction of the mill, thereby using, according to need completely new and replaced sorted, worn beams, respectively.

2. A method according to claim 1, wherein beams of three different height categories are used, one of these categories comprising the unused beams.

3. A method according to claim 1 or 2, wherein the replacement is always carried out on the basis of whether or not the highest beams need to be replaced.

4. A method according to claim 1, wherein when beams are replaced, a beam is always replaced with a beam classified in the category in question.

5. A method according to claim 1, wherein the completely new high beams are placed at the replacement stage in the position of some entirely rejectable beams and the suitable variation of height in the peripheral direction is arranged, when needed, by replacing or rearranging the other beams.

6. A method according to claim 2, wherein when beams are replaced, a beam is always replaced with a beam classified in the category in question.

7. A method according to claim 3, wherein when beams are replaced, a beam is always replaced with a beam classified in the category in question.

8. A method according to claim 2, wherein the completely new high beams are placed at the replacement stage in the position of some entirely rejectable beams and the suitable variation of height in the peripheral direction is arranged, when needed, by replacing or rearranging the other beams.

9. A method according to claim 3, wherein the completely new high beams are placed at the replacement stage in the position of some entirely rejectable beams and the suitable variation of height in the peripheral direction is arranged, when needed, by replacing or rearranging the other beams.

* * * * *